US005551882A

United States Patent [19]

Whiteman, Jr. et al.

[11] Patent Number: 5,551,882

[45] Date of Patent: Sep. 3, 1996

[54] STACKABLE CONNECTOR

[75] Inventors: Robert N. Whiteman, Jr.; Robert W. Walker, both of Harrisburg; James P. Moser, Steelton, all of Pa.

[73] Assignee: The Whitaker Corporation, Wilmington, Del.

[21] Appl. No.: 409,128

[22] Filed: Mar. 22, 1995

[51] Int. Cl.[6] ..... H01R 33/08; H01R 39/00

[52] U.S. Cl. ..... 439/21; 439/22; 439/27; 439/31; 439/314; 439/317; 439/446; 439/651; 439/653

[58] Field of Search ..... 439/11, 13, 18, 439/21, 22, 27, 31, 77, 314, 315, 317, 319, 446, 493, 651, 653

[56] References Cited

U.S. PATENT DOCUMENTS

| | | | |
|---|---|---|---|
| 2,199,560 | 5/1940 | Faller | 439/314 |
| 2,447,026 | 8/1948 | O'Brien et al. | 439/11 |
| 3,550,061 | 12/1970 | Sukup | 339/8 |
| 3,740,697 | 6/1973 | Van Son | 439/651 |
| 3,771,106 | 11/1973 | Matsumoto et al. | 339/52 |
| 3,808,577 | 4/1974 | Mathanser | 439/21 |
| 4,005,923 | 2/1977 | Davis, Jr. | 439/651 |
| 4,026,618 | 5/1977 | Straka | 439/21 |
| 4,367,002 | 1/1983 | Waghorn et al. | 439/314 |
| 4,673,228 | 6/1987 | Ditzig | 439/21 |
| 4,699,592 | 10/1987 | Gallo et al. | 439/27 |
| 4,743,207 | 5/1988 | Clark | 439/317 |
| 4,842,525 | 6/1989 | Galloway et al. | 439/34 |
| 4,850,880 | 7/1989 | Zayat, Jr. et al. | 439/11 |
| 4,904,189 | 2/1990 | Hallings | 439/13 |
| 5,049,083 | 9/1991 | Lin | 439/26 |
| 5,082,448 | 1/1992 | Kang | 439/22 |
| 5,173,065 | 12/1992 | Herlache et al. | 439/741 |
| 5,352,122 | 10/1994 | Speyer et al. | 439/13 |
| 5,372,517 | 12/1994 | Levesque | 439/314 |
| 5,376,757 | 12/1994 | Marsh et al. | 439/651 |
| 5,399,093 | 3/1995 | Schneider et al. | 439/21 |

*Primary Examiner*—Gary E. Elkins

[57] ABSTRACT

An electrical connector (1) constructed to mate with a connector (1) of duplicate construction comprising: a front mating ring (3), multiple contacts (4) brushing respective concentric circuits (10) on a rotatable circuit board (9), said contacts (4) being connected to respective wires (16) of an electrical cable (17), a rear facing socket (28) receiving a front mating ring (3) of another, duplicate connector (1), and the front mating ring (3) and the rear facing socket (28) being connected electrically together.

9 Claims, 8 Drawing Sheets

STACKABLE CONNECTOR

FIELD OF THE INVENTION

The invention relates to an electrical connector for plugging into a receptacle outlet, and, more particularly, to an electrical connector that will plug into an outlet receptacle as well as another connector of duplicate construction.

BACKGROUND OF THE INVENTION

At a workplace, electrically powered machines are brought together in a group to perform a sequence of machine operations. The machines require connection to a source of electrical power. Additionally the machines are controlled by electronic signals and perform their operations by responding to the electronic signals. Electrical cables on the machines are plugged into outlet receptacles that supply electrical power and other electrical signals to the machines. A generous number of outlet receptacles must be conveniently located to avoid a shortage of outlet receptacles for use by the machines. A common practice is to provide a large number of outlet receptacles as an assurance their will be no shortage. However, such a practice results in a redundant number of receptacles being available at all times. The problem faced is that redundant receptacles are costly and increases the need for repairs and maintenance for receptacles that are used infrequently. A need satisfied by the invention, is to reduce the need for redundant receptacle outlets together with reducing the cost and maintenance associated with such receptacle outlets.

SUMMARY OF THE INVENTION

The invention resides to an electrical connector for an electrical cable that plugs to an outlet receptacle, and is constructed for plugging to another connector of duplicate construction, which enables a number of connectors to plug to one another and use the same receptacle outlet. In addition, each of the connectors is pivotable about a universal joint, which enables the connectors to plug into one another at different orientations with respect to one another.

A connector with a universal joint is disclosed in U.S. Pat. No. 5,049,083, and comprises, an electrical cord terminated with conductive contacts, the contacts engage and brush against concentric conductive tracks on a circuit board. The cord is rotatable with respect to the circuit board, providing a universal joint. The connector is unable to plug to another connector of duplicate construction.

Accordingly an advantage of the invention resides in an electrical connector with a universal joint that is constructed to plug to another connector of duplicate construction.

An embodiment of duplicate electrical connectors will be described that are constructed to plug into receptacle outlets that supply electrical power and signals to the cables. To reduce the need for large numbers of electrical sockets, the connectors are designed to plug into each other to comprise a stack of connectors. The connectors in the stack are plugged together to provide electrical connection through the stack with a single receptacle outlet.

The connectors have a rotatable ring with a projecting lever that can pivot through an arc. The lever pivots between two space apart stops on the connector. A projecting key on the ring will extend through a keyway of a socket in the rear of a connector of duplicate construction. The lever then will rotate the key through an arc to lock the key inside the socket. Thereby, the connector is mated with the socket in the connector of duplicate constructions and the mated connectors are locked together. The mated connectors can be connected to a single receptacle outlet, which advantageously reduces the need for redundant receptacle outlets. An embodiment of the invention comprises, a rotatable electrical connector that is capable of being locked in position to resist rotation.

DESCRIPTION OF THE DRAWINGS

An embodiment of the invention will now be described by way of example with reference to the accompanying drawings, according to which.

DETAILED DESCRIPTION

Figure 1:
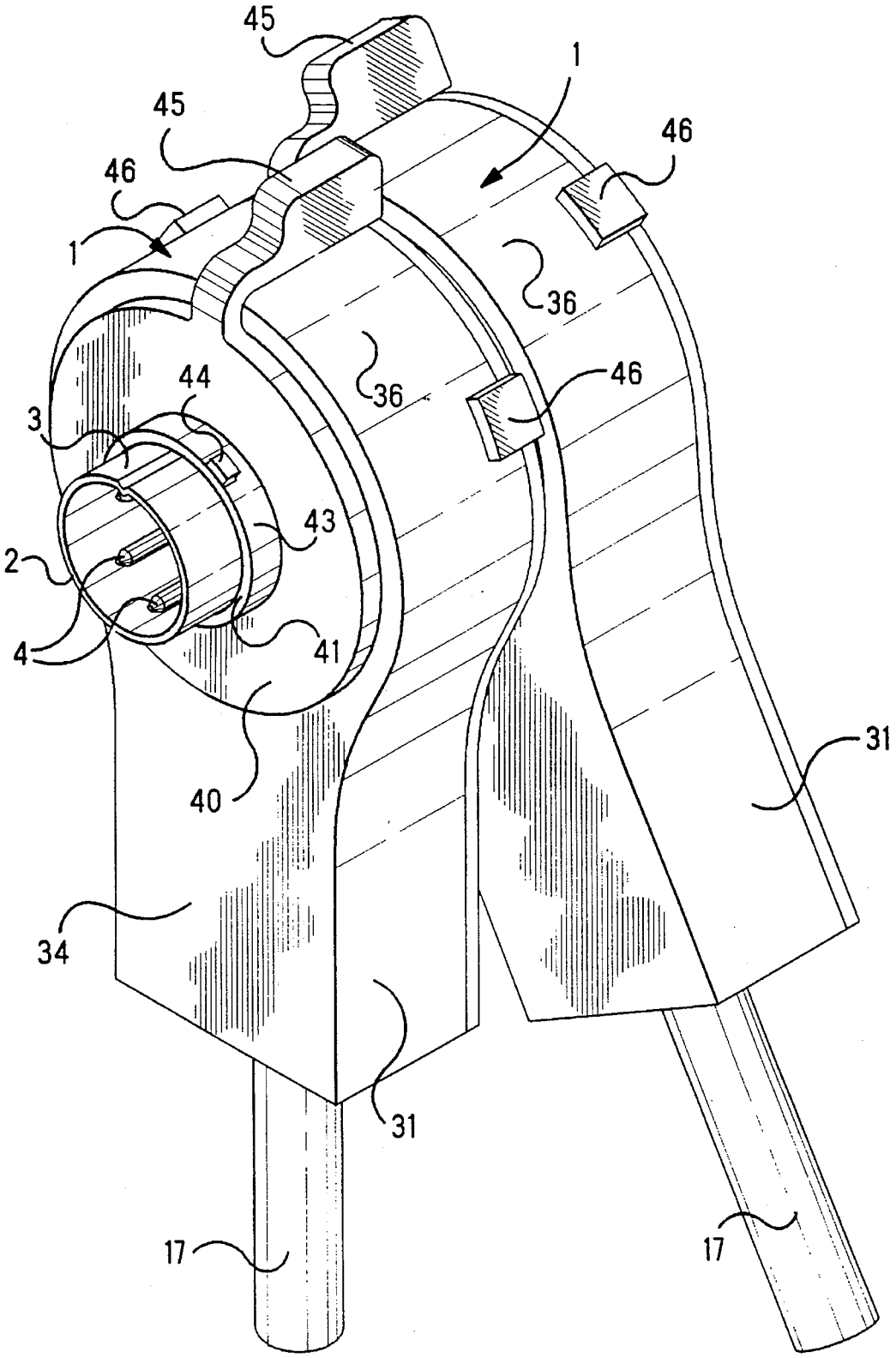
FIG. 1 is an isometric view of two electrical connectors of duplicate construction plugged together and projecting at different angles, each connector comprising a front ring and a rear facing socket.
Figure 3:
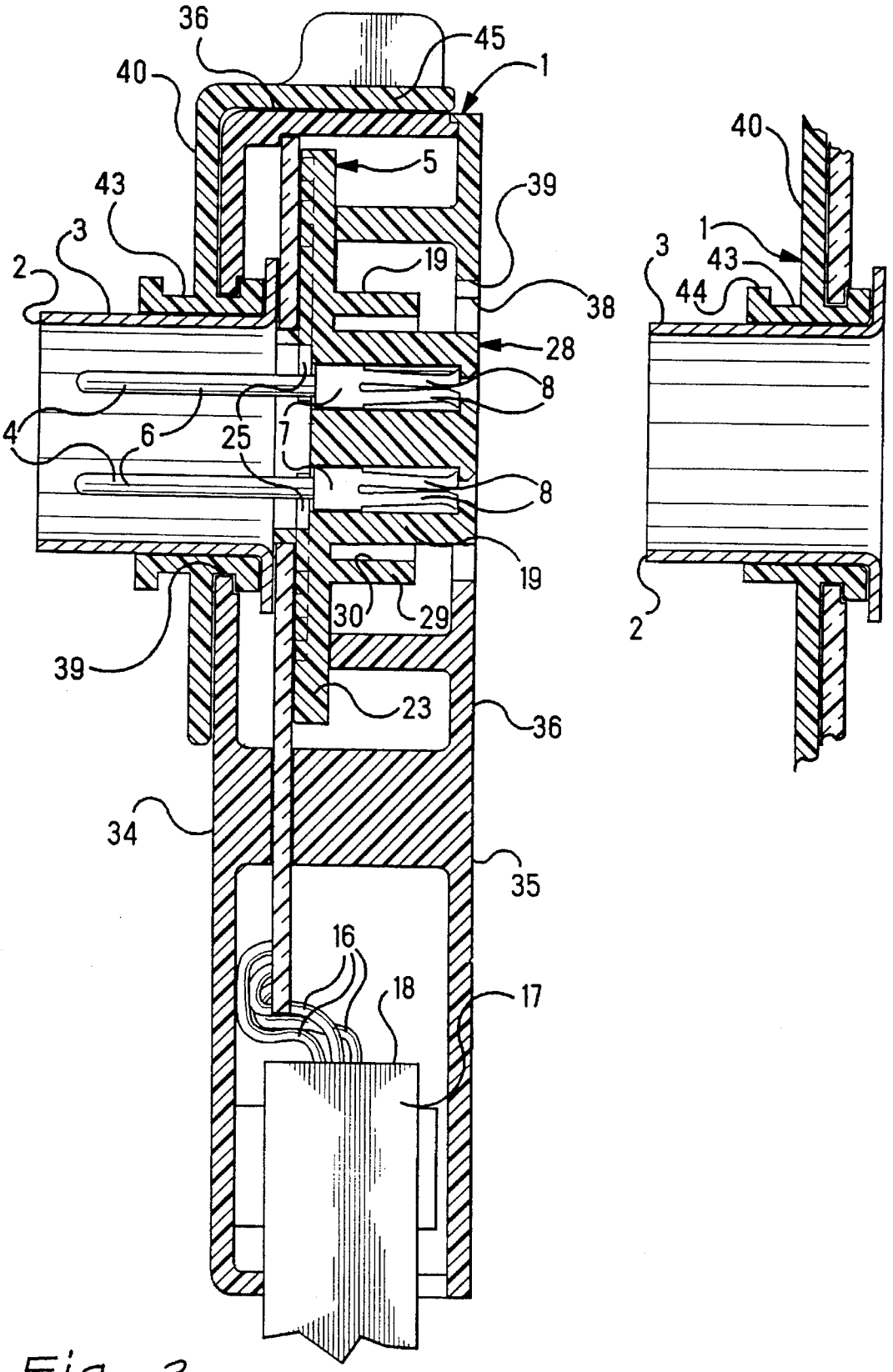
FIG. 3 is a section view of one of the connectors shown in FIG. 1.
Figure 4:
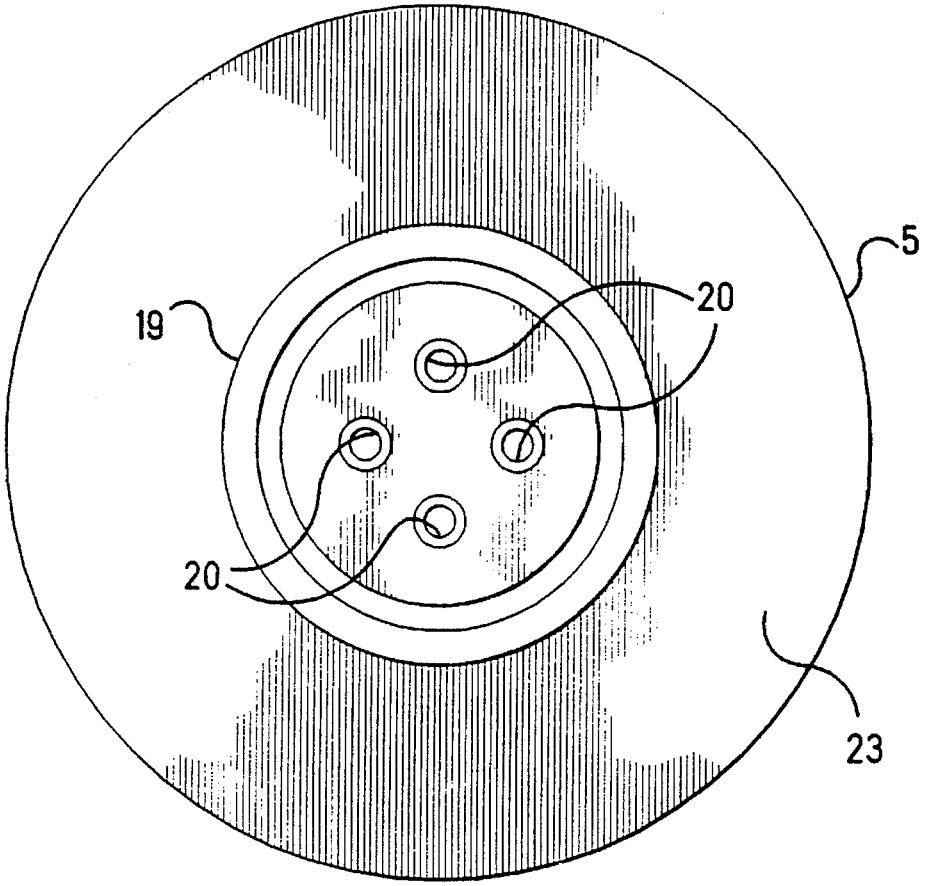
FIG. 4 is a top view of an insulating housing of the connector shown in FIG. 1.

With more particular reference to FIGS. 1 and 3 of the drawings, a first electrical connector 1 comprises, a front mating end 2 on a conductive, front mating ring 3, and multiple electrical contacts 4 within an insulating housing 5.

Each of the contacts 4 is of unitary conductive construction and comprises, an elongated post 6 extending toward the front mating end 2, and a rear facing electrical receptacle 7 defined by radially spaced part spring fingers 8.

Figure 8:
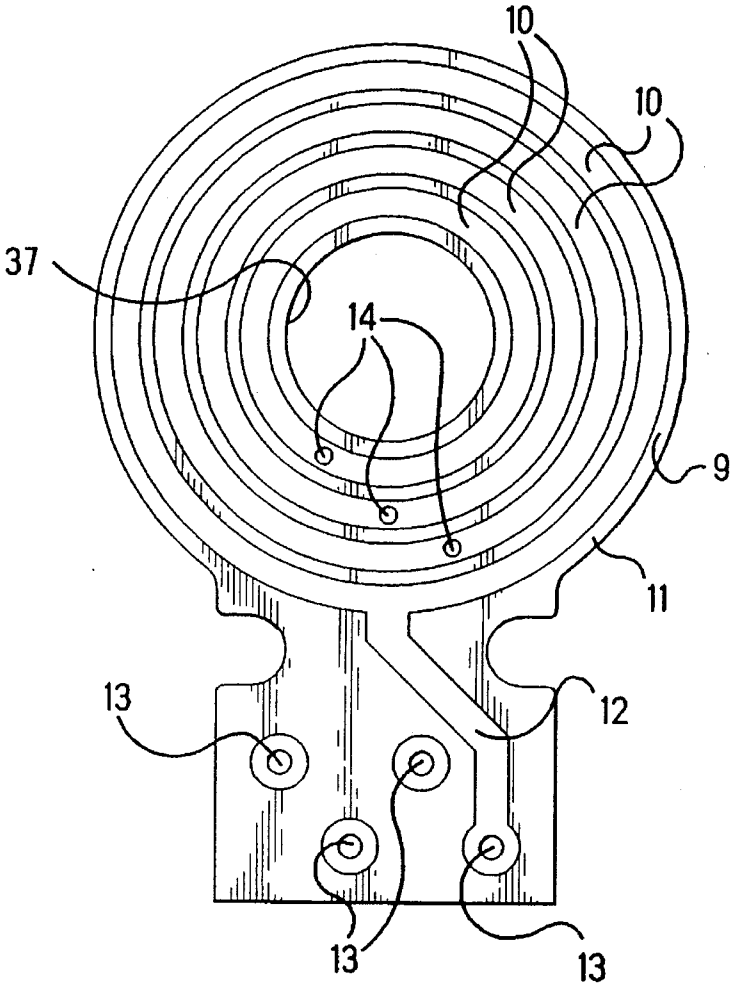
FIG. 8 is a view of a second side of the circuit board shown in FIG. 7.
Figure 7:
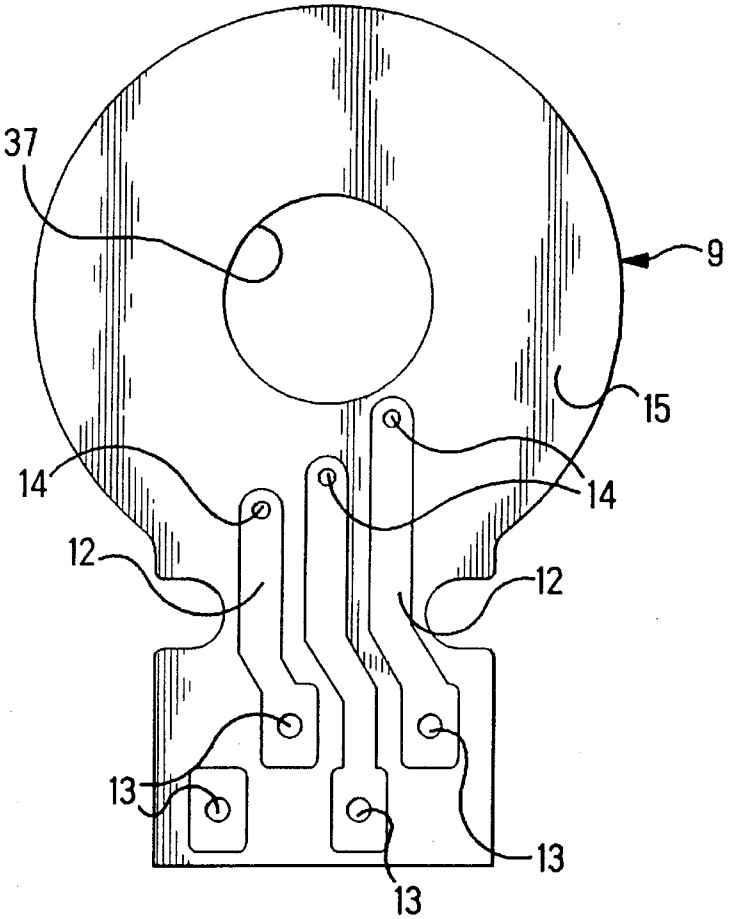
FIG. 7 is a view of one side of a circuit board.

With reference to FIGS. 7 and 8, a flat circuit board 9 has a series of conductive arcuate circuit traces or circuits 10 on one side 11. The traces 10 are concentric about an axis. An outermost one of the traces 10 is connected by a circuit trace 12 to connect with plating that lines a first wire receiving hole 13 through the circuit board 9. The remaining arcuate circuit traces 10 are connected to respective additional plated though holes 14. These respective, plated through holes 14 extend through the thickness of the circuit board 9 to connect with respective additional circuit traces 12 on another side 15 on the circuit board 9. These circuit traces 12 extend to plating that lines respective additional wire receiving holes 13.

Figure 9:
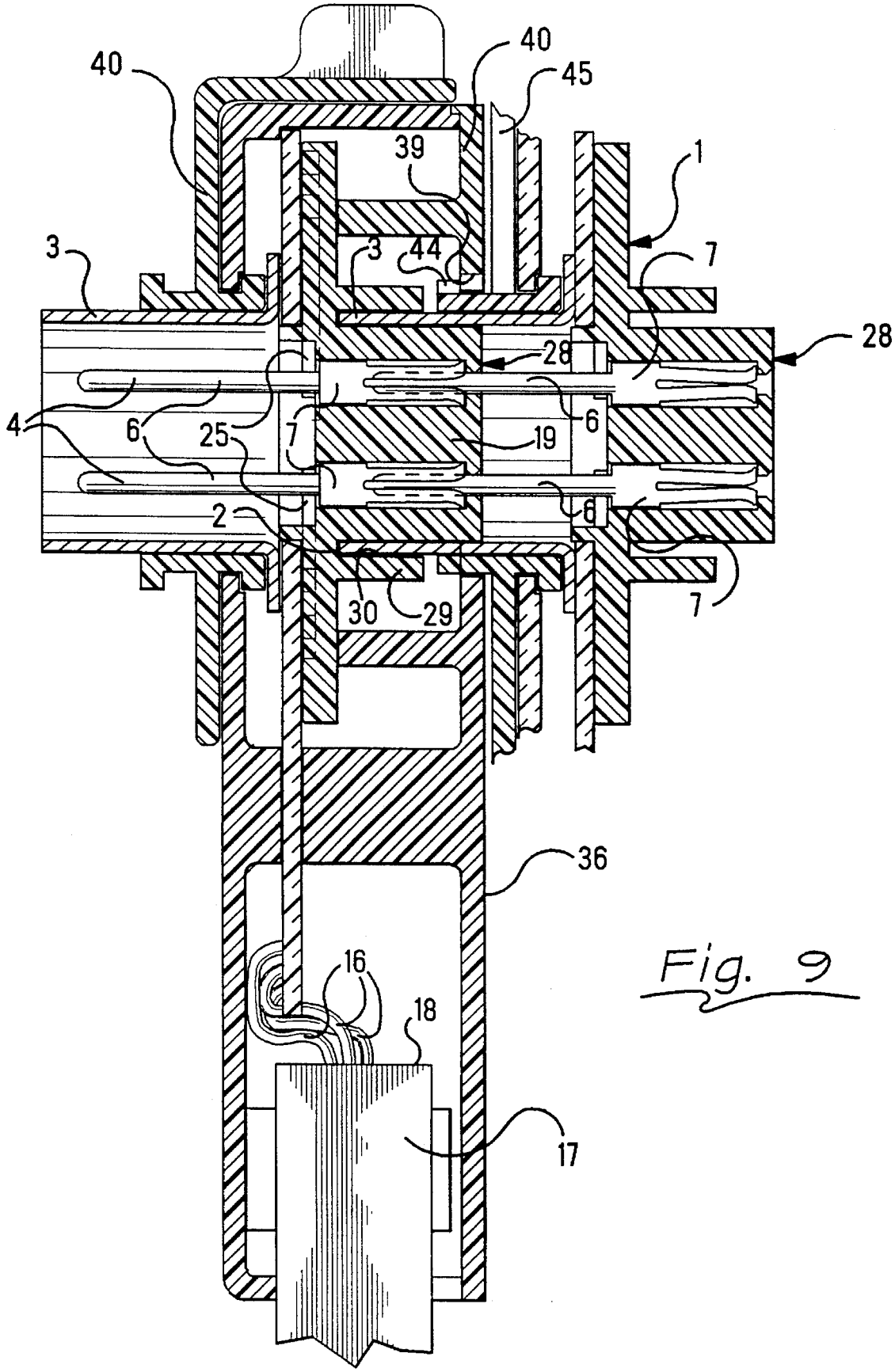
FIG. 9 is a view similar to FIG. 3, of two connectors plugged together.

With reference to FIGS. 3 and 9, respective insulated wires 16 in an electrical cable 17, comprise insulation covering wire conductors, the insulated wires 16 project from an outer jacket 18 of the cable. The wire conductors are inserted through respective wire receiving holes 13. Solder is used to join, and to establish electrical connection of, the wire conductors to plating material that lines respective wire receiving holes 13. Thereby, the wire conductors establish electrical connection with the plating that lines the holes 13, and further electrical connections with respective arcuate traces 10 on the circuit board 9.

Figure 5:
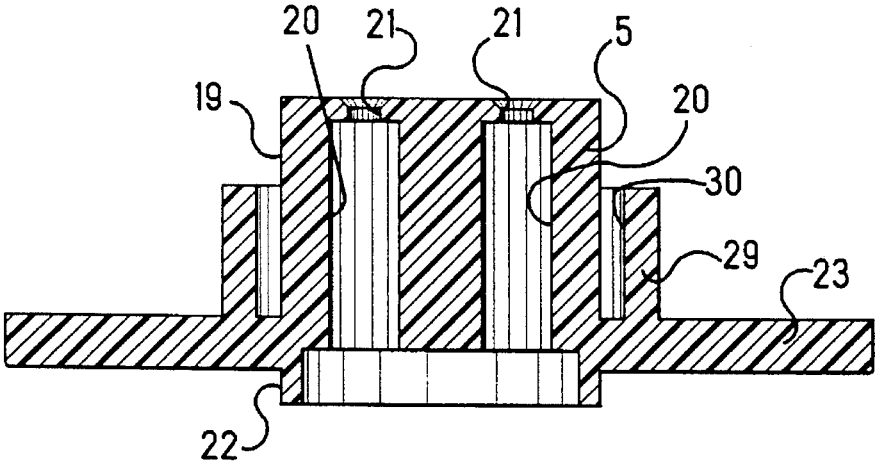
FIG. 5 is a section view of the housing shown in FIG. 4.

With reference to FIGS. 3, 5 and 9, the housing 5 is of unitary, molded plastic construction, and comprises, a cylindrical body 19 having a central axis, with contact receiving cavities 20 extending parallel to the axis of the cylindrical body 19. Inwardly projecting lips 21 encircle front ends of respective cavities 20. The lips 21 reduce the diameters of front openings of the cavities 20. The lips 21 overlap partially the receptacles 7, FIG. 3, and resist forward movement of the contacts 4 within the cavities 20. A rear facing, cylindrical hub 22 on the housing 5 is aligned concentrically with the axis of the cylindrical body 20. The hub 22 and the cylindrical body 5 extend from opposite sides of a circular flange 23 on the housing 5.

Figure 6:
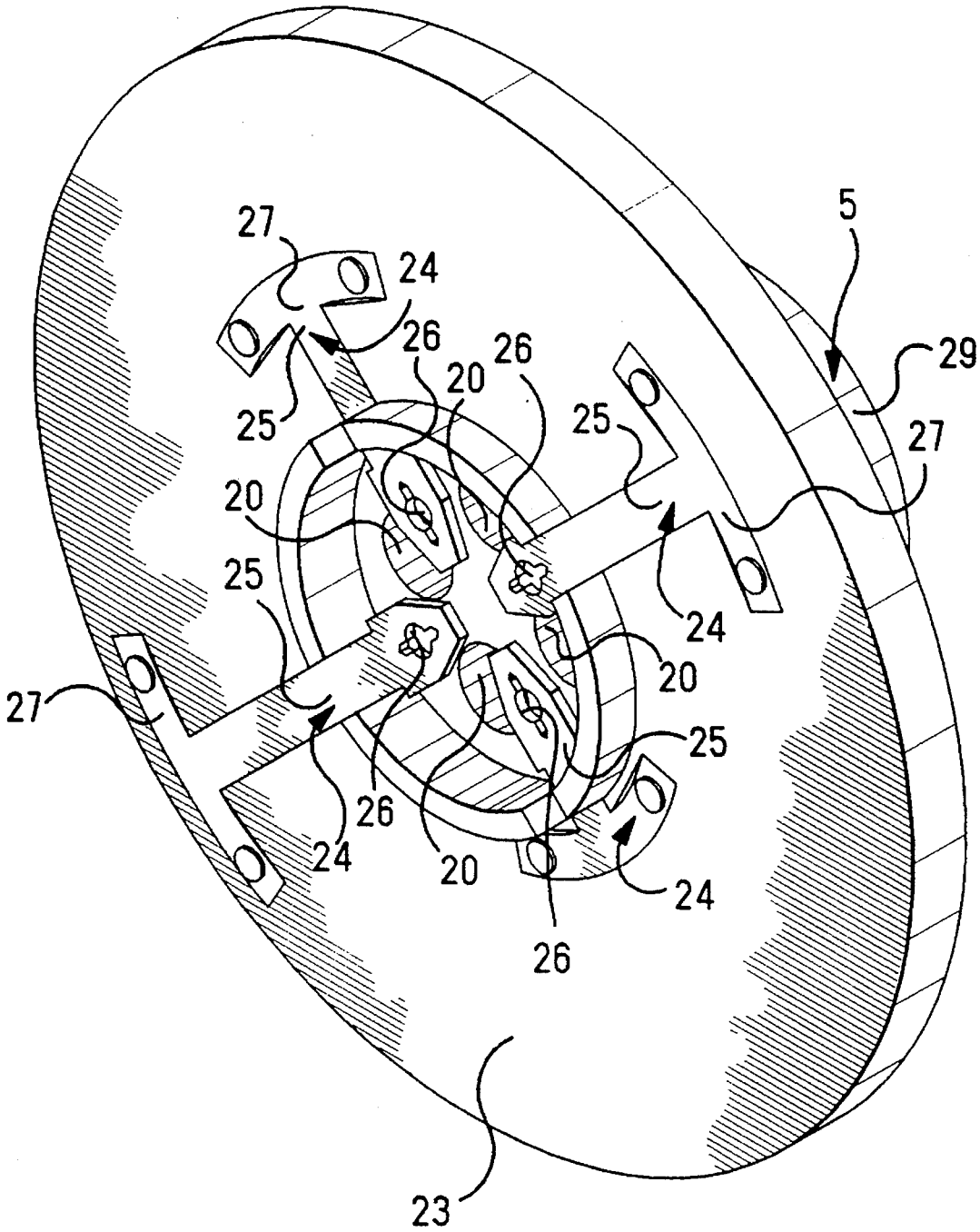
FIG. 6 is an isometric view of the housing shown in FIG. 5 together with electrical contacts.

With reference to FIG. 6, multiple electrically conducting brush contacts 24 are mounted on the flange 2. The brush contacts 24 are constructed of unitary, sheets of metal having respective thin thickness planes. Elongated stems 25 on respective brush contacts 24 extend through openings in the hub 23 to be in alignment with respective cavities 20 in the housing 5. Slotted openings 26 in respective stems 25 are aligned with respective cavities 20. When the contacts 4 are in the cavities 20, the pins 6 extend outwardly through the hub 22. FIGS. 3 and 9. The slotted openings 26 encircle and frictionally grip respective pins 6 to establish electrical connections to provide composite contacts 4 brushing respective races or circuits 10.

The brush contacts 24 extend radially outward from the hub 22, and have respective different lengths. The outer ends 27 of the brush contacts 24 are arcuate in the thickness planes of the contacts 24. The outer ends 27 extend along respective arcs that are coextensive with respective arcuate traces 10 on the circuit board 9, when the circuit board 9 is received with a central opening 37 for rotation over the hub 22. The brush contacts 24 maintain continuous electrical engagement with respective arcuate traces 10 during relative rotational movement of the circuit board 9 with respect to the brush contacts 24. The brush contacts 24 maintain continuous engagement with respective pins 6 on the contacts 4. A universal joint is provided that allows pivotal movement of the cable 17 and the circuit board 9 to which the cable 17 is attached, while the brush contacts 24 maintain continuous engagement with respective contacts 4.

With reference to FIG. 3, a front mating end of the ring 3 forms the front mating end 2 of the connector 1. The pins 6 extend toward the front mating end 2. Together, the ring 3 and the pins 6 are adapted to plug to an electrical outlet receptacle, not shown, of a wiring system that supplies electrical voltage and power to a number of outlet receptacles.

Figure 10:
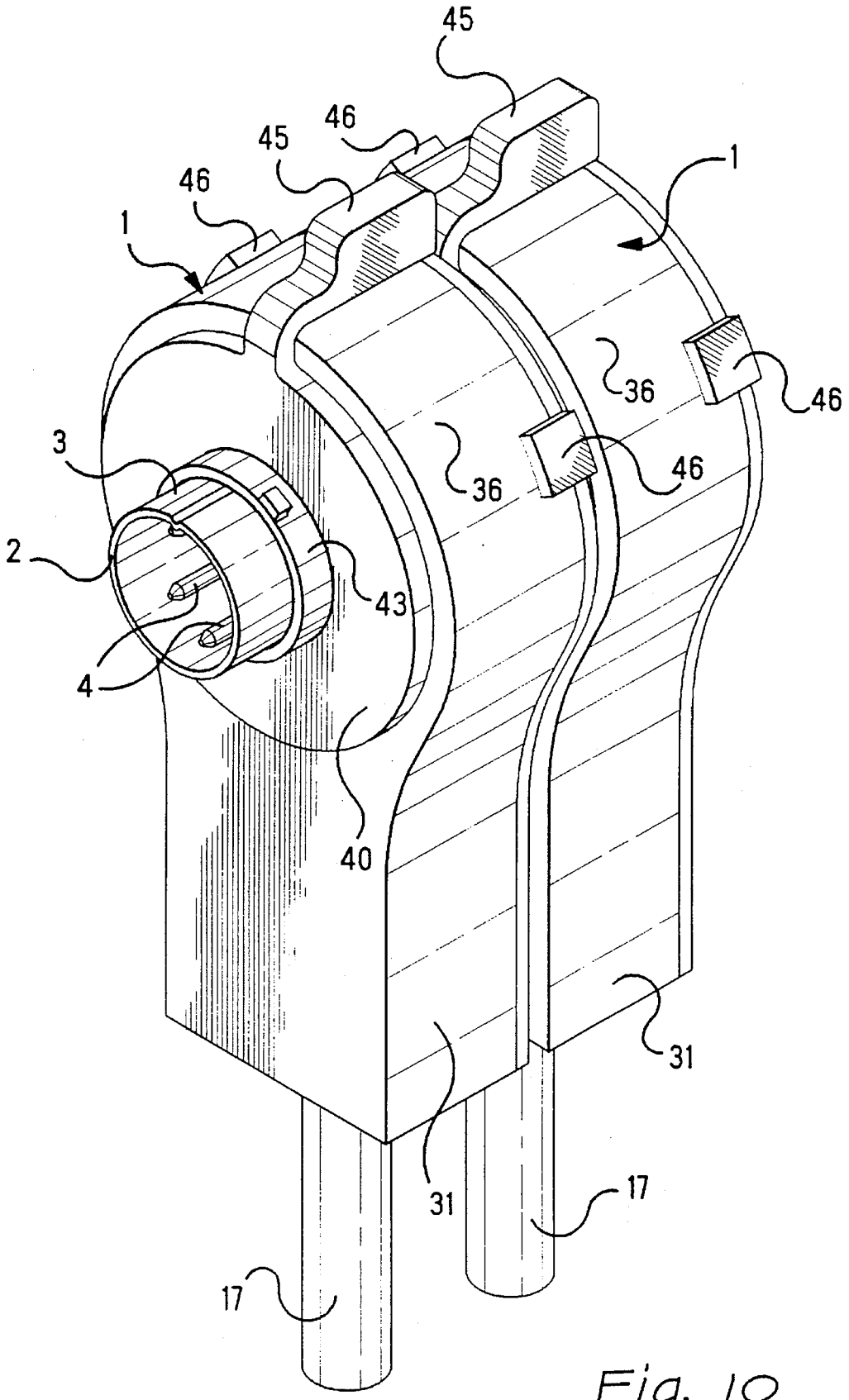
FIG. 10 is a view similar to FIG. 1 of two connectors plugged together.

An advantage of the connector 1 resides in providing a rear facing socket 28, FIGS. 3 and 9, to which another connector 1 of duplicate construction can plug. Two connectors 1 of duplicate construction are plugged to one another are shown in FIG. 1. Additional connectors 1 of duplicate construction can be plugged to one another. The rear facing socket 28 comprises, the cylindrical body 19, and the multiple receptacles 7 on respective contacts 4 that are rear facing. A cylindrical web 29 on the unitary housing 5 is concentric with the cylindrical body . A ring receiving space 30 is defined between the web 29 and the cylindrical body 19, and comprises a socket portion adapted to receive a corresponding ring 3 on a duplicate connector 1, when the duplicate connector 1 is plugged to the first connector 1. The cavities 20 and the receptacles 7 on the contacts 4 will receive respective pins 6 on a duplicate connector 1 when the duplicate connector 1 is plugged to the first connector 1, as shown in FIG. 10. Thus, the contacts 4 on the first connector 1 provide electrical connections to both the front mating end 2 of the first connector 1 and the rear facing socket 28 on the first connector 1.

Figure 2:
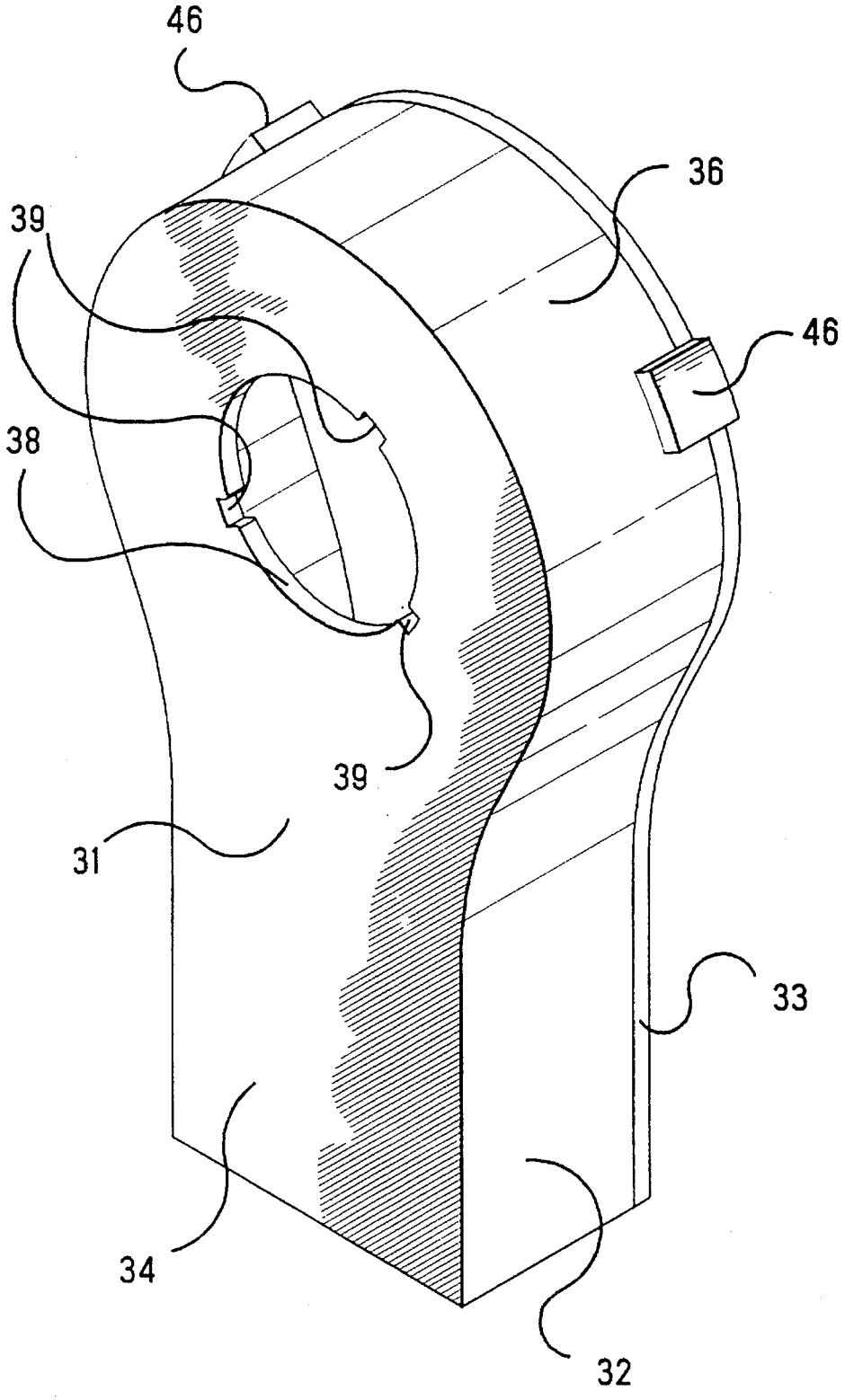
FIG. 2 is an isometric view of an outer shell of the connector shown in FIG. 1, illustrating portion of the rear facing socket.

With reference to FIGS. 1 and 2, a conductive enclosure 31 comprises two shell parts 32, 33 that are assembled to each other. The shell parts 32, 33 comprise a front facing side 34 and a rear facing side 35. The shell parts 32, 33 encircle a section of the cable 17 to provide a cable strain relief, FIGS. 3 and 9. The shell parts 32, 33 are shaped to provide an arcuate end wall 36 on the enclosure 31. The arcuate end wall 36 is concentric with a circular opening 38, FIG. 2, in the rear facing side 34. The end wall 36 and the opening 38 are aligned with the axis of the cylindrical body 19 and the rear facing socket 28. Three, circumferentially spaced part keyways 39 project outward radially from the opening 38. When a connector 1 of duplicate construction is plugged to the first connector 1, as in FIG. 10, the front mating end 2 of the connector 1 of duplicate construction will enter the opening 38 in the first connector 1. The arcuate end wall 36 is concentric with a circular opening 39, FIG. 3, in the front facing side 34, through which the front mating ring 3 projects. An enlarged lip on the rear of the ring 3 is trapped behind the front facing side 34 to prevent withdrawal of the ring 3 from the opening 39. Thus, the arcuate end wall 36 is concentric with the axis of the front mating ring 3 and the rear facing socket 28.

With respect to FIGS. 1, 3 and 9, a rotatable disc 40 with a central opening 41 is mounted for rotation over the front facing ring 3. The disc 40 has a central hub 43 received through the opening 39 in the front side 34. The hub 43 projects forwardly of the front side 34, encircling the ring 3. A radially projecting key 44 projects outwardly from the hub 43, and is spaced relationship from the disc 40, and from the front side 34. The disc 40 has a radially projecting lever 45 that extends over the front side 34. The lever 45 extends over the arcuate end wall 36, and has a projecting handle 46 for manual manipulation. It is understood that a connector 1 of duplicate construction will also be provided with the rotatable disk 40 constructed as described in conjunction with the first connector 1. When the connector 1 of duplicate construction is plugged to the first connector 1, the lever 45 is rotated to align the key 44 with one of the keyways 39 on the first connector 1. This allows the duplicate connector 1 to plug into the first connector 1, aligned as shown in FIG. 10. Because the universal joint permits pivotal movement, the connectors 1 can undergo relative rotation with respect to one another, and the cables 17 attached to respective connectors 1 can extend at different angles, FIG. 1.

An advantage is provided, that the connectors 1 can plug to one another, and then be pivoted at different angles as allowed by alignment of the key 44 on one of the connectors 1 selectively with one of the multiple arcuately spaced apart keyways 39 on another one of the connectors 1. With reference to FIGS. 3 and 9, after plugging the duplicate connector 1 to the first connector 1, the key 44 on the duplicate connector 1 will enter the enclosure of the first connector 1. The lever 45 is manually manipulated to pivot the lever 45, and to rotate the disk 40. The key 44 on the duplicate connector 1 is then pivoted circumferentially with respect to the opening 38 in the rear side 35 of the first connector 1, until the key 44 is behind the rear side 35. The key 44 interlocks with the first connector 1 to lock the connectors 1 together. Unlocking is accomplished by rotating the lever 45 until the key 44 is again aligned with a keyway 39. The duplicate connector 1 is unplugged when the key 44 is aligned with one of the multiple keyways 39. Pivotal movement of the lever 45 is limited between two projecting stops 46 that are spaced apart from each other, and are on the arcuate end 36 of the first connector 1.

An advantage of the connector resides in providing a rear facing socket, FIGS. 3 and 9, to which another connector of duplicate construction can plug.

An advantage is provided that duplicate connectors plug to one another and are interlocked.

An advantage is provided, that the connectors can plug to one another, and then be pivoted at different angles as allowed by alignment of the key on one of the connectors 1 selectively with one of the multiple arcuately spaced apart keyways on another one of the connectors 1.

What is claimed is:

1. An electrical connector constructed to mate with a connector of duplicate construction comprising: a front mating ring, multiple contacts brushing respective concentric circuits on a rotatable circuit board, said contacts being connected to respective wires of an electrical cable, a rear facing socket receiving a front mating ring of another, duplicate connector, and the front mating ring and the rear facing socket being connected electrically together.

2. An electrical connector as recited in claim 1, further comprising: multiple keyways spaced circumferentially on the socket, a front facing ring constructed to fit in a rear facing socket in a connector of duplicate construction, one projecting key on the ring to enter a corresponding keyway to receive the ring in a rear facing socket in a duplicate connector, the ring being rotatable within a rear facing socket in a duplicate connector.

3. An electrical connector as recited in claim 1, further comprising: a lever projecting from the ring and being pivotally displaceable to rotate the ring.

4. An electrical connector as recited in claim 1, further comprising: spaced apart stops to limit pivotal displacement of the lever, the lever being displaceable between the spaced apart stops.

5. An electrical connector constructed to mate with a connector of duplicate construction comprising: a front mating ring, multiple contacts brushing respective concentric circuits on a rotatable circuit board, said contacts being connected to respective wires of an electrical cable, a rear facing socket, multiple keyways spaced circumferentially on the socket, a front facing ring constructed to fit in a rear facing socket in a connector of duplicate construction, one projecting key on the ring to enter a corresponding keyway to receive the ring in a rear facing socket in a duplicate connector, the ring being rotatable within a rear facing socket in a duplicate connector.

6. An electrical connector as recited in claim 5, further comprising: a lever projecting from the ring and being pivotally displaceable to rotate the ring.

7. An electrical connector as recited in claim 5, further comprising: spaced apart stops to limit pivotal displacement of the lever, the lever being displaceable between the spaced apart stops.

8. An electrical connector as recited in claim 5, further comprising: a lever projecting from the ring and being pivotally displaceable to rotate the ring, and spaced apart stops to limit pivotal displacement of the lever, the lever being displaceable between the spaced apart stops.

9. An electrical connector constructed to mate with a connector of duplicate construction comprising: a front mating ring, multiple contacts brushing respective concentric circuits on a rotatable circuit board, said contacts being connected to respective wires of an electrical cable, a rear facing socket, multiple keyways spaced circumferentially on the socket, a front facing ring constructed to fit in a rear facing socket in a connector of duplicate construction, one projecting key on the ring to enter a corresponding keyway to receive the ring in a rear facing socket in a duplicate connector, the ring being rotatable within a rear facing socket in a duplicate connector.

* * * * *